United States Patent [19]

Frint et al.

[11] 4,283,372

[45] Aug. 11, 1981

[54] RECOVERY OF ALKALI VALUES FROM SODIUM BICARBONATE-CONTAINING ORE WITH AMMONIA

[75] Inventors: William R. Frint, Green River, Wyo.; William C. Copenhafer, Yardley, Pa.; Michael L. Pinsky, Mt. Holly, N.J.

[73] Assignee: Intermountain Research and Devel. Corp., Green River, Wyo.

[21] Appl. No.: 116,511

[22] Filed: Jan. 29, 1980

Related U.S. Application Data

[63] Continuation-in-part of Ser. No. 28,033, Apr. 9, 1979, abandoned.

[51] Int. Cl.[3] ..... C22B 26/10; C01D 7/00; E21C 41/08

[52] U.S. Cl. ..... 423/206 T; 423/421; 423/425; 423/427; 23/302 T; 299/5

[58] Field of Search ..... 423/206 T, 422, 421, 423/425, 427; 23/302 T; 299/5

[56] References Cited

U.S. PATENT DOCUMENTS

| | | | |
|---|---|---|---|
| 1,937,937 | 12/1933 | Allen et al. | 423/190 |
| 1,966,114 | 7/1934 | Cunningham et al. | 423/425 |
| 1,980,691 | 11/1934 | MacMullin | 423/424 |
| 1,994,892 | 3/1935 | MacMullin et al. | 423/421 |
| 2,005,868 | 6/1935 | MacMullin et al. | 423/427 |
| 2,014,536 | 9/1935 | MacMullin et al. | 423/421 |
| 2,024,679 | 12/1935 | Cunningham | 423/421 |
| 2,038,025 | 4/1936 | Cunningham et al. | 423/425 |
| 2,120,287 | 6/1938 | MacMullin | 423/421 |
| 3,184,287 | 5/1965 | Gancy | 423/206 T |
| 3,953,073 | 4/1976 | Kube | 423/206 T |

OTHER PUBLICATIONS

Thorpe's Dictionary of Applied Chemistry, Longmans, Green and Co. London 1950 vol. X pp. 819–824, 842–843.

Hackh's Chemical Dictionary The Blakiston Co., New York 1953 pp. 46 and 31.

*Primary Examiner*—Earl C. Thomas
*Assistant Examiner*—Gary P. Straub
*Attorney, Agent, or Firm*—Christopher Egolf

[57] ABSTRACT

A method for recovering alkali value from sodium bicarbonate-containing ore by utilizing an aqueous solvent containing ammonia. The aqueous ammonia solvent is contacted with the ore to solubilize the sodium bicarbonate-containing ore. The alkali values in the resulting solution are crystallized, preferably as sodium carbonate monohydrate or as sodium sesquicarbonate, which may be processed to recover soda ash. Aqueous ammonia solvent is preferably regenerated from the mother liquor remaining after recovery of the solids, the ammonia solvent then being employed in a cyclic method to recover additional alkali values from the ore.

19 Claims, 3 Drawing Figures

RECOVERY OF ALKALI VALUES FROM SODIUM BICARBONATE-CONTAINING ORE WITH AMMONIA

This application is a continuation-in-part of application U.S. Ser. No. 28,033 filed Apr. 9, 1979, now abandoned.

FIELD OF THE INVENTION

This invention relates to a method for the recovery of alkali values from sodium bicarbonate-containing ore. More particularly, sodium bicarbonate-containing ore such as trona is treated with an aqueous ammonia solvent to facilitate recovery of its alkali values, preferably as soda ash.

BACKGROUND OF THE PRIOR ART

Most soda ash (sodium carbonate) produced in the United States is obtained from naturally occurring subterranean trona ore deposits located in southwestern Wyoming. Trona ore consists mainly of sodium sesquicarbonate, $Na_2CO_3.NaHCO_3.2H_2O$, a hydrated sodium carbonate, sodium bicarbonate double salt.

At the present time, these trona deposits are mechanically mined and the dry-mined trona ore converted to soda ash by either the sesquicarbonate process or the monohydrate process. In the sesquicarbonate process, the trona ore is dissolved in hot aqueous alkali solution and, after separation of the resulting solution from the insolubles, sodium sesquicarbonate is crystallized from solution by cooling. The sesquicarbonate crystals are separated from the mother liquor and then calcined to recover soda ash.

In the monohydrate process, the dry-mined trona ore is first calcined to convert its bicarbonate content to sodium carbonate and is then dissolved in water. After the resulting solution is separated from the insolubles, sodium carbonate monohydrate is precipitated by evaporative crystallization. The monohydrate crystals are separated from the mother liquor and dried to recover soda ash.

Solution mining techniques have been proposed as an alternative to mechanical mining for exploiting trona ore deposits but have not yet been used commercially to recover soda ash. Representative solution mining processes are disclosed in U.S. Pat. Nos. 3,184,287 and 3,953,073, both of which employ an aqueous sodium hydroxide solution as the mining fluid; and in U.S. Pat. No. 2,388,009, which employs a hot carbonate solution as the mining fluid. These prior art solution mining processes, however, involve substantial energy inputs, in manufacturing caustic soda and in supplying the requisite high solution temperature, respectively.

In addition to trona, nahcolite (predominantly $NaHCO_3$) and wegscheiderite (predominantly $Na_2CO_3.3NaHCO_3$) are also sodium bicarbonate-containing ores from which it is possible to recover soda ash, after conversion of the bicarbonate to carbonate. Known deposits of nahcolite and wegscheiderite are located primarily in Utah and Colorado. No commercial operations are presently known to be recovering soda ash from these $NaHCO_3$-bearing minerals.

The present invention provides an economical method of recovering alkali values from dry-mined or solution-mined sodium bicarbonate-containing ores through the use of ammonia.

Ammonia is ordinarily associated with soda ash production in the context of the Solvay or ammonia-soda process. In the Solvay process, soda ash is prepared from sodium chloride, ammonia, carbon dioxide and lime by a series of reactions which provide for virtually complete recovery and reuse of the ammonia and unused carbon dioxide. Environmental concerns and high costs have led to the demise of the Solvay process for manufacturing soda ash in the United States, where abundant deposits of naturally occurring trona have provided an alternative source for soda ash.

Ammonia has not previously been used in processes involving the recovery of soda ash from naturally occurring trona ore deposits, either in the monohydrate or sesquicarbonate processes for preparing soda ash from dry-mined trona ore or in prior art solution mining techniques disclosed as being applicable to trona.

The present invention employs ammonia in a novel fashion to recover alkali values, preferably as soda ash, from naturally occurring sodium bicarbonate-containing ore deposits.

SUMMARY OF THE INVENTION

In accordance with the present invention, alkali values are recovered from sodium bicarbonate-containing ore in a method which comprises contacting the ore with an aqueous ammonia solvent to solubilize at least a portion of the ore, separating the resulting solution from the undissolved portion of the ore, and recovering the alkali values from the separated solution.

The $NaHCO_3$-containing ore may be trona, nahcolite, wegscheiderite or mixtures of these and may be treated either as mechanically mined ore or in situ by solution mining techniques.

The aqueous ammonia solvent should be contacted with the $NaHCO_3$-bearing ore for sufficient time to provide an aqueous solution having sufficient alkali values dissolved therein to permit their subsequent crystallization as a sodium salt selected from sodium sesquicarbonate and sodium carbonate and its hydrates. The ammonia in the aqueous solvent is desirably present in concentrations of at least 0.1% by weight, with 0.5 to 9% by weight ammonia being preferred.

A preferred embodiment of the invention involves a cyclic method for recovering alkali values from trona ore, which may be either mechanically mined ore or in situ subterranean ore deposits. In the former cyclic method, dry-mined trona ore is desirably contacted with aqueous ammonia solvent in an amount and concentration sufficient to effect complete dissolution of sodium sesquicarbonate in the trona ore. The resulting solution is separated from the undissolved portion of the trona ore, and alkali values are subsequently crystallized and recovered from the solution. The mother liquor which remains after recovery of the crystallized alkali values is recycled as aqueous ammonia solvent, after regeneration as necessary, to treat additional dry-mined trona ore in a repetition of the cycle of recovery.

In the cyclic recovery of alkali values from subterranean trona ore deposits, an aqueous ammonia solvent is introduced into the region of the trona ore deposit via solution mining techniques. The aqueous ammonia solvent desirably contains sufficient ammonia to effect congruent dissolution of the sodium sesquicarbonate in the ore. At least a portion of the resulting solution is withdrawn from the region of the trona deposit, and alkali values are subsequently crystallized and recovered from the solution.

Aqueous ammonia solvent is regenerated, as necessary, from the mother liquor which remains after recovery of the crystallized alkali values. Sufficient water and ammonia are added to the mother liquor to compensate for the volume of solvent left in the subterranean cavity formed by solubilization of the trona ore. The mother liquor is then recycled as aqueous ammonia solvent to the region of the trona ore deposit and the cycle of recovery repeated.

The alkali values are preferably recovered from the solution by crystallization of sodium carbonate monohydrate, which may be dried to form soda ash. Alternatively, sodium sesquicarbonate may be recovered as the alkali product. Crystallization is desirably effected by the addition of ammonia as a salting-out agent to the solution. Crystallization of a particular alkali product species, sodium carbonate monohydrate or sodium sesquicarbonate, may be controlled through the amount of salting-out ammonia added and the amounts of carbonate and bicarbonate in the solution.

The recovered sodium carbonate monohydrate is preferably dried to prepare soda ash. Sodium sesquicarbonate may either be dried to recover a sesquicarbonate product or may be calcined to recover soda ash.

DETAILED DESCRIPTION

Figure 1:
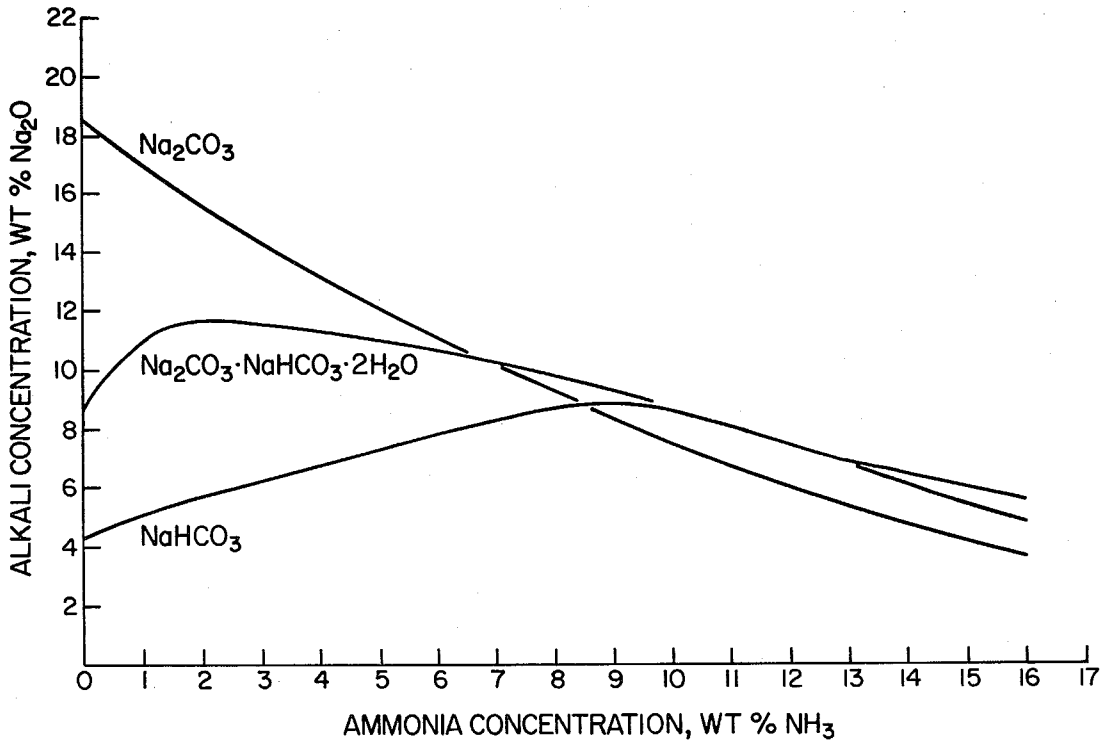
FIG. 1 is a diagram which illustrates the solubilities of sodium sesquicarbonate, sodium bicarbonate, and sodium carbonate in aqueous ammonia solutions at a temperature of 45° C., as a function of ammonia concentration.

Suitable for treatment according to the method of this invention are large trona ore deposits that exist in the Green River formation in southwestern Wyoming, as well as nahcolite and wegscheiderite deposits which are also present in the same general area.

The trona deposits are found at depths ranging from 800 feet to 4,000 feet, and consist of one or more beds typically from 5 to 30 feet thick separated by equally thick layers of water-insoluble shale. These trona beds typically are composed of sodium sesquicarbonate with less than 10–25% insoluble impurities. Some beds may also be contaminated with substantial amounts of sodium chloride.

The sodium bicarbonate-containing ore may be treated according to the method of this invention as mechanically mined ore which has been excavated and brought to the surface by conventional mining techniques for processing. Alternatively, the $NaHCO_3$-bearing ore may be treated in situ with the aqueous ammonia solvent, by solution mining techniques, and the resulting solution brought to the surface for recovery of its alkali values.

Mechanically mining the ore has the advantage of being independent of the subsequent surface treatment procedures, i.e., dry-mined ore can be stockpiled until needed without disruption of the surface treatment operations. Mechanically mined ore may often be treated at a faster rate than in situ ore deposits since the mechanical agitation of drymined ore (with its greater dissolving surface area) with the aqueous ammonia solvent promotes rapid attainment of an essentially saturated solution.

Solution mining the sodium bicarbonate-bearing ore, however, completely eliminates the sizable cost associated with subterranean mechanical mining and is therefore preferred over conventional mechanical mining.

The recovery of alkali values from sodium bicarbonate-bearing ores is ordinarily hindered by the low solubility of sodium bicarbonate in water. The use of water as a solvent to solubilize $NaHCO_3$-bearing ores requires uneconomically large volumes of water to achieve reasonable recovery rates: the solubility of $NaHCO_3$ in water at temperatures of from 30° to 50° C. is only about 10 to 12% $NaHCO_3$ by weight.

When the $NaHCO_3$-bearing ore also contains $Na_2CO_3$ (i.e., trona or wegscheiderite), the low $NaHCO_3$ solubility results in a disproportionate dissolution of the ore. A higher proportion of the more soluble sodium carbonate (28 to 32% by weight $Na_2CO_3$ at 30° to 50° C.) is dissolved in solution, and the balance of sodium bicarbonate in the ore either reprecipitates or remains undissolved. The reprecipitation of sodium bicarbonate often creates a barrier layer over the dissolving ore surface which retards solubilization of the ore and can eventually prevent further dissolution of the ore from beneath the barrier layer.

The use of caustic soda, to react with the sodium bicarbonate and thereby eliminate the formation of a barrier layer, has been proposed in U.S. Pat. No. 3,184,287 and No. 3,953,073. However, caustic soda must either be manufactured at the treatment plant site or be made available through shipment to that area.

The present invention employs ammonia in aqueous solution to improve the solubilization characteristics and promote the degree of solubilization of $NaHCO_3$-bearing ores over what would ordinarily result when using pure water as a solvent. Ammonia has been discovered to be extremely efficient in solubilizing $NaHCO_3$-bearing ores, especially trona ore.

A chemical reaction between the ammonia in the aqueous ammonia solvent and the $NaHCO_3$-portion of the ore is believed to be partially responsible for providing enhanced solubilization of $NaHCO_3$-containing ores. The ammonia in the aqueous solvent, under some circumstances, appears to neutralize solubilized bicarbonate and form more soluble sodium carbonate. For purposes of this disclosure, such a reaction is designated as the "neutralization" of sodium bicarbonate, although the terms "chemical calcination", "decarbonation" and "deprotonation" of sodium bicarbonate have been used to refer to the same reaction mechanism. The reaction mechanism may also be viewed as effecting the removal of carbon dioxide from the sodium bicarbonate constituent of the ore to yield sodium carbonate.

When the $NaHCO_3$-bearing ore is trona (sodium sesquicarbonate), the ammonia may neutralize the solubilized bicarbonate from the sodium sesquicarbonate according to the following reaction:

$$2(Na_2CO_3.NaHCO_3.2H_2O)+2NH_3 \rightarrow 3Na_2CO_3+(NH_4)_2CO_3+4H_2O$$

The reaction of ammonia with wegscheiderite, $Na_2CO_3.3NaHCO_3$, appears to be analogous to that involving the reaction of ammonia with trona ore:

$$2(Na_2CO_3.3NaHCO_3)+6NH_3 \rightarrow 5Na_2CO_3+3(NH_4)_2CO_3$$

In the solubilization of nacholite (sodium bicarbonate) with aqueous ammonia solvent, the following reactions may occur:

$$2NaHCO_3+NH_3 \rightarrow Na_2CO_3+NH_4HCO_3$$

$$2NaHCO_3=2NH_3 \rightarrow Na_2CO_3+(NH_4)_2CO_3$$

The concentration of ammonia in the aqueous ammonia solvent which provides satisfactory solubilization of the $NaHCO_3$-bearing ore is at least 0.1%, expressed as % by weight $NH_3$ based on the solution weight. Concentrations of ammonia in the aqueous solvent ranging from about 0.5% to 9% by weight $NH_3$ are generally preferred.

The precise ammonia concentration to be employed will depend on the $NaHCO_3$-bearing ore being treated, and may be affected by the presence of impurities such as NaCl and by dissolved alkali values in the aqueous ammonia solvent.

With trona as the $NaHCO_3$-bearing ore, the concentration of ammonia in the aqueous ammonia solvent is desirably 0.5 by 6% by weight $NH_3$, and most preferably, 1 to 4% by weight ammonia.

Higher ammonia concentrations in the aqueous ammonia solvent, up to 9% by weight $NH_3$ or more, are particularly useful with nahcolite, with 7 to 11% by weight $NH_3$ being preferred for use with this $NaHCO_3$-containing ore. For $NaHCO_3$-containing ore such as trona, however, such higher ammonia concentrations in the solvent may result in some undesired crystallization of alkali values from solution, if the solution should become alkali-saturated while the ore is being contacted with the solvent.

The ammonia concentration in the aqueous ammonia solvent which yields optimal solubilization characteristics will vary according to the sodium bicarbonate content of the $NaHCO_3$-containing ore being treated. Solubilization of nahcolite, as the $NaHCO_3$-containing ore, typically calls for an aqueous ammonia solvent containing a higher ammonia concentration than that employed with trona ore, because of the former's higher proportion of bicarbonate.

The relative solubilities of sodium sesquicarbonate and of sodium bicarbonate in aqueous ammonia solvents of varying ammonia content at a temperature of 45° C. are illustrated in FIG. 1. In the Figure, the concentration of alkali solubilized is expressed as weight percent (equivalent) $Na_2O$. The aqueous ammonia solvent was prepared from ammonium hydroxide and water; ammonia concentration is expressed as weight percent $NH_3$.

Sodium sesquicarbonate achieves maximum solubility with an aqueous ammonia solvent containing 2% $NH_3$. Sodium bicarbonate, on the other hand, reaches maximum solubility only when the aqueous ammonia solvent contains about 9% $NH_3$. Furthermore, the maximum amount of sodium bicarbonate which dissolves (8.8% $Na_2O$) is significantly less than that obtained for sodium sesquicarbonate (11.7% $Na_2O$).

For comparison, the solubility of sodium carbonate in aqueous ammonia solvent is also shown in the Figure. Its solubility is a maximum in an $NH_3$-free solvent (water) and declines with increasing ammonia content in the solvent.

The aqueous ammonia solvent, in the cyclic embodiment of this invention, will ordinarily contain other chemical species besides ammonia because of its being recycled. The solvent will typically contain dissolved sodium and ammonium carbonates and bicarbonates, which result from the ammonia solvent's neutralization and solubilization of the $NaHCO_3$-bearing ore and which are not completely removed during recovery of alkali values from the mining solution.

Such concentrations of carbonate and bicarbonate, especially the latter, are desirably minimized in the recycled aqueous ammonia solvent since their presence ordinarily diminishes its capacity for solubilization of $NaHCO_3$-containing ore.

The compositions of aqueous ammonia solvent, the resulting mining solution, and the mother liquor which remains after recovery of alkali values may each be conveniently expressed in terms of percentages by weight of (equivalent) $NH_3$, $Na_2O$, $CO_2$ and NaCl, if present. This system of expressing solution analyses avoids ambiguities sometimes created when solutions are defined in terms of the chemicals used to prepare them, yet provides a measurement basis which completely and simply defines the solution. The sum of these percentages with water totals 100%.

By way of example, identical solutions which contain 1.7% $NH_3$, 6.2 $Na_2O$ and 8.8% $CO_2$ (and 83.3% $H_2O$) may be prepared from either of the following two mixtures:

(i) 16.8 g $NaHCO_3$, 1.7 g $NH_3$ and 81.5 g $H_2O$; or (ii) 10.6 g $Na_2CO_3$, 7.9 g $NH_4HCO_3$ and 81.5 g $H_2O$.

Both aqueous solutions would be chemically identical, and are conveniently defined in terms of weight percentages of $NH_3$, $Na_2O$ and $CO_2$ despite the fact that they actually contain $NH_3$ and $NH_4^+$, $Na^+$, $HCO_3^-$, $CO_3^=$ ions, and other chemical species.

When trona is the $NaHCO_3$-bearing ore, the aqueous ammonia solvent should have a composition which provides for congruent dissolution of the sodium sesquicarbonate in the ore. The compositions of aqueous ammonia solvents which provide congruent dissolution of sodium sesquicarbonate may be determined by reference to FIG. 2, a phase diagram which illustrates the compositions of saturated NaCl-free solutions produced by the congruent dissolution of sodium sesquicarbonate.

Figure 2:
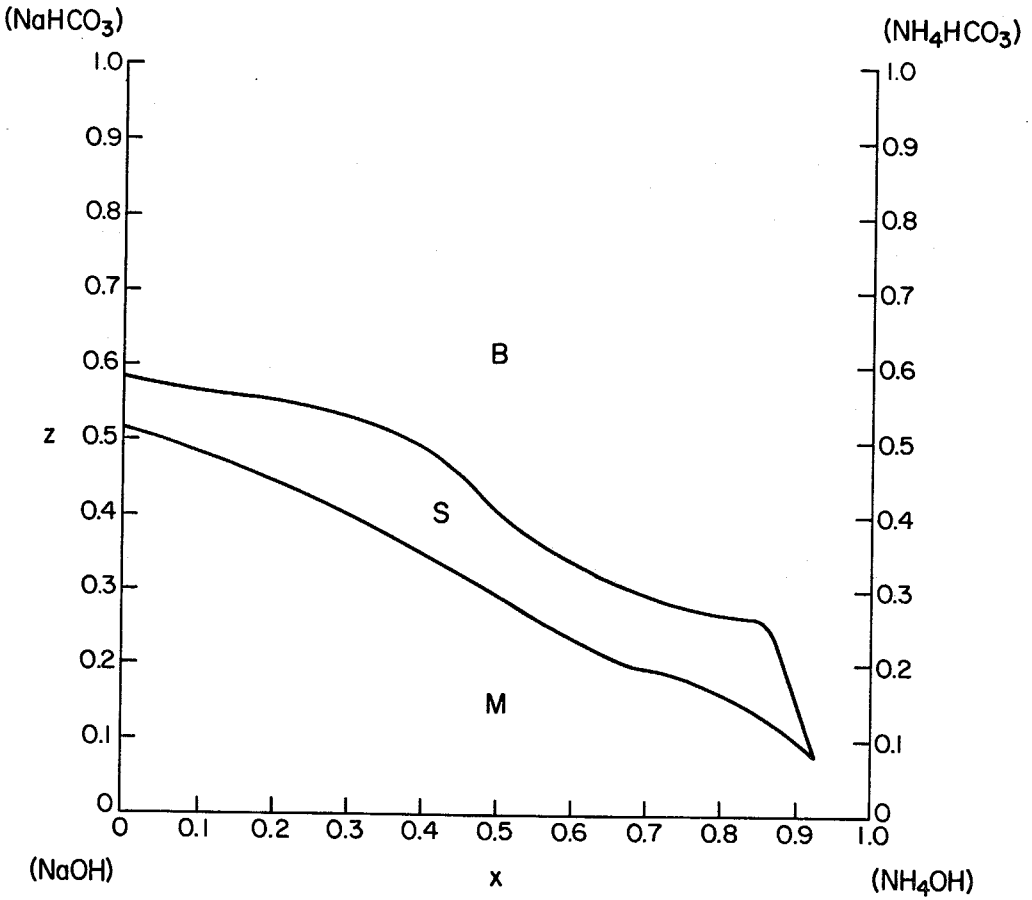
FIG. 2 is a phase diagram which illustrates the stable solid phases in equilibrium with saturated, aqueous NaCl-free solutions containing (equivalent) $NH_3$, $Na_2O$ and $CO_2$.

Saturated solutions which are in equilibrium with the solid phase, sodium sesquicarbonate, are those whose compositions lie within the region labelled "S" in FIG. 2. In the Figure, the area lying above the sesquicarbonate region (S) generally consists of solutions which are saturated with respect to sodium bicarbonate (B). Similarly, solutions in the area below the sesquicarbonate region generally are saturated with respect to sodium carbonate monohydrate (M). Although the phase boundary data in FIG. 2 were obtained at a temperature of 45° C., the diagram is generally applicable at other solution temperatures, above and below 45° C., as well.

Solution compositions in FIG. 2 are expressed in terms of the phase diagram coordinates x and z, which are the abscissa and ordinate, respectively. The x coordinate represents the mole fraction of ammonium ($NH_4^+$) to ammonium and sodium ($Na^+$) present. An $x=0$ thus corresponds to 0% $NH_3$ and $x=1.0$ corresponds to an aqueous ammonia solution.

The value of x may readily be determined from weight percentages of ammonia ($NH_3$) and sodium oxide ($Na_2O$), and salt (NaCl) if present, in a solution by the formula:

$$x = \frac{\% NH_3/17}{\% NH_3/17 + \% Na_2O/31 + \% NaCl/58.5}$$

It should be noted that the value of $Na_2O$ is based on sodium present from alkali sources only; sodium that is present as sodium chloride is not included as $Na_2O$ but is treated separately as NaCl in calculating these coordinates.

The z coordinate represents the mole fraction of bicarbonate ($HCO_3^-$) to bicarbonate and hydroxide ($OH^-$) present. A z=0 corresponds to 0% bicarbonate, i.e. a hydroxide ($OH^-$) solution, and z=1.0 corresponds to a bicarbonate ($HCO_3^-$) solution. At x=0 (no $NH_3$ present), z=0 represents an aqueous sodium hydroxide solution, and z values of 0.5, 0.667 and 1.0 correspond to the compositions of sodium carbonate, sodium sesquicarbonate and sodium bicarbonate, respectively. At x=1.0 (no $Na^+$ present), z=0 corresponds to an aqueous ammonia solution. Also at x=1.0, z values of 0.5 and 1.0 correspond to the compositions of ammonia carbonate and ammonium bicarbonate, respectively.

The value of z for a solution may be determined from its weight percentages of $NH_3$, $Na_2O$ and $CO_2$ by the formula:

$$z = \frac{\% CO_2/44}{\% NH_3/17 + \% Na_2O/31}$$

A third coordinate y (not shown on the Figure) is necessary to define solution compositions containing salt; when NaCl=0, y=1.0. The value of y may be calculated in the same manner used for x and z, by the formula:

$$y = \frac{\% NH_3/17 + \% Na_2O/31}{\% NH_3/17 + \% Na_2O/31 + \% NaCl/58.5}$$

Also not shown on the Figure are isohydrol (h) lines (constant h lines), which may be calculated by the formula:

$$h = \frac{\left(100 - \left[\% Na_2O\left(\frac{40}{31}\right) + \% NH_3\left(\frac{35}{17}\right) + \% CO_2 + \% NaCl\right]\right)\frac{1}{18}}{\% NH_3/17 + \% Na_2O/31 + \% NaCl/58.5}$$

Conversely, the $NH_3$, $Na_2O$ and $CO_2$ weight percentages may be calculated from a given set of x, y, z and h values, as follows:

$$\%NH_3 = 17(x)(q)/y-x$$

$$\%Na_2O = 31(q)$$

$$\%CO_2 = 44(y)(z)(q)/y-x$$

$$\%NaCl = 58.5(q)\ (1-y)/y-x)$$

where $$q = \frac{100/18}{\left(h + \frac{35}{18}\right)\left(\frac{x}{y-x}\right) + \left(h + \frac{40}{18}\right) + \left(\frac{h}{58.5} + \frac{1}{18}\right)(58.5)\left(\frac{1-y}{y-x}\right) + \frac{44}{18}\left(\frac{zy}{y-x}\right)}$$

The compositions of aqueous ammonia solvents which are capable of congruently dissolving sodium sesquicarbonate may be determined by reference to FIG. 2. Any point ($P_1$) which lies within the sodium sesquicarbonate region (S) shown in FIG. 2, or on the phase boundary of that region, represents a saturated alkali solution composition, as would be formed by congruently dissolving sodium sesquicarbonate with aqueous ammonia solvent. The composition of sodium sesquicarbonate is represented by the point ($P_0$) at z=0.667 for x=0 on FIG. 2. Once the desired saturated alkali solution composition $P_1$ is chosen, the composition of the aqueous ammonia solvent ($P_2$) is fixed and lies along the line $P_0$–$P_1$ extending from $P_1$.

Figure 3:
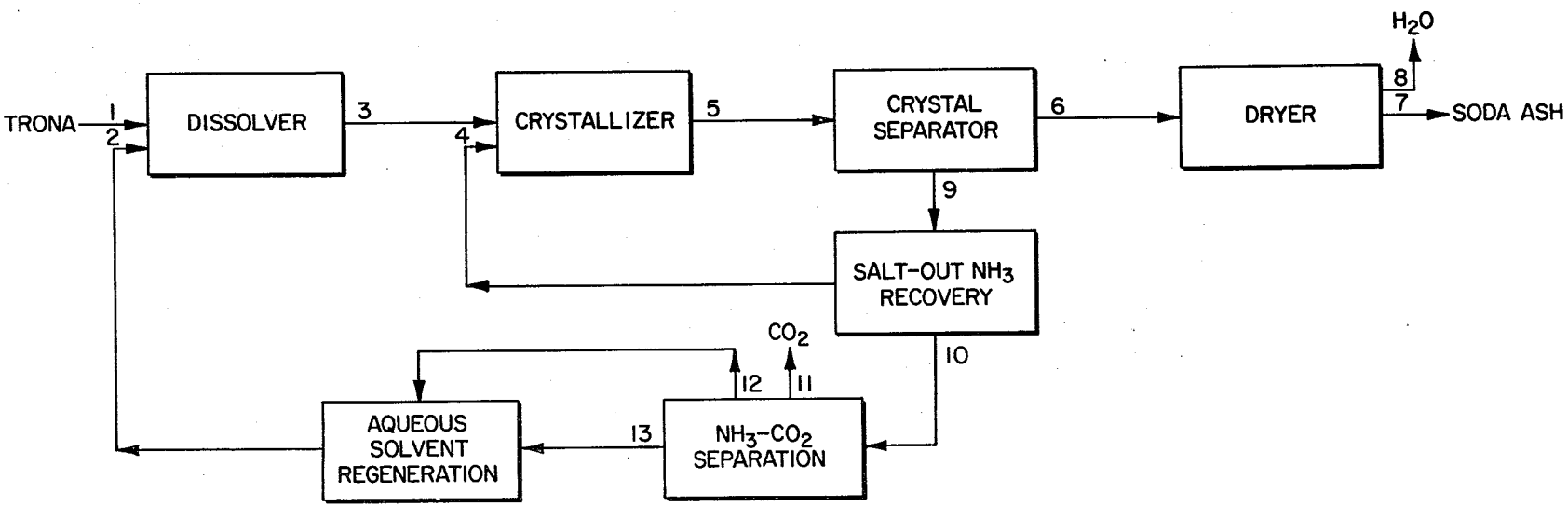
FIG. 3 is a flow sheet depicting a preferred embodiment of the invention, in which soda ash is recovered from trona ore in a cyclic method.

For example, a representative saturated alkali solution (stream 3 of the cyclic process shown in FIG. 3) has the composition 13.5% $Na_2O$, 12.0% $CO_2$ and 1.8% $NH_3$ (x=0.20, z=0.50, h=3.7). Such a saturated alkali solution, containing 13.5 g $Na_2O$, 12.0 g $CO_2$, 1.8 g $NH_3$ and 72.7 g $H_2O$ (100 g basis), may be expressed in terms of its equivalent sodium bicarbonate and sodium carbonate content: 9.1 g $NaHCO_3$, 17.3 g $Na_2CO_3$, 1.8 g $NH_3$ and 71.7 g $H_2O$. The alkali solution thus contains the equivalent of 24.6 g sodium sesquicarbonate (9.1 $NaHCO_3$, 11.6 g $Na_2CO_3$ and 3.9 g $H_2O$) dissolved in it. Subtraction of this sodium sesquicarbonate content from the alkali solution yields an aqueous ammonia solvent containing 5.7 g $Na_2CO_3$, 1.8 g $NH_3$ and 67.8 g $H_2O$. This aqueous ammonia solvent therefore contains 7.6% $Na_2CO_3$, 2.4% $NH_3$ and 89.9% $H_2O$, which may alternatively be expressed as 3.3% $Na_2O$, 3.2% $CO_2$ and 2.4% $NH_3$ with x=0.50, z=0.25 and h=16.6.

In a preferred embodiment of the invention, the method is operated cyclically using additional ammonia as a crystallizing agent. The cyclic operation and use of salting-out ammonia in this preferred method require that the aqueous ammonia solvent have a composition whose x coordinate is about 0.05 to about 0.8 and whose x and z coordinates lie within the region in FIG. 2 defined by the sesquicarbonate-bicarbonate phase boundary and by the line passing through the points (x=0, z=0.5) and (x=1.0, z=0). Preferably, the aqueous ammonia solvent has an x value of from 0.1 to 0.6. The corresponding preferred z value for the solvent should lie close to or on the line connecting points (x=0, z=0.5) and (x=1.0, z=0). The solutions on this line are saturated, equivalent to compositions obtained by dissolving sodium carbonate (x=0, z=0.5) in aqueous ammonia (x=1.0, z=0).

A particularly suitable aqueous ammonia solvent, for use in cyclic embodiments in which sodium sesquicarbonate is recovered with ammonia as the crystallizing agent, is one containing 2.0% $NH_3$, 4.0%$Na_2O$ and 3.8% $CO_2$, which corresponds to x=0.48 and z=0.35 and h=19.6.

An aqueous ammonia solvent composition particularly suited for recovering the alkali values as sodium carbonate monohydrate, in a cyclic method which utilizes ammonia as the crystallizing means, is one containing 2.4% $NH_3$, 4.5% $Na_2O$ and 3.2% $CO_2$, which corresponds to x=0.50, z=0.25 and h=16.6.

The aqueous ammonia solvent, when recycled in cyclic embodiments of the invention, may also contain soluble impurities normally associated in small amounts with the $NaHCO_3$-bearing ore. These soluble impurities are in addition to the ammonium and sodium carbonate and bicarbonate constituents previously mentioned.

Soluble impurities such as sulfates, borates, phosphates and chlorides generally do not accumulate in appreciable concentrations in the regenerated and recycled aqueous ammonia solvent, especially when the ore is treated using solution mining techniques. This is because the volume of solvent which is left behind and remains in the subterranean cavity to replace the dissolved $NaHCO_3$-bearing ore functions as a purge stream.

Amounts of sodium chloride in excess of the normal trace amounts may be allowed to accumulate and reach a steady-state concentration in the regenerated and recycled aqueous ammonia solvent. The presence of such sodium chloride ordinarily does not adversely affect the method of this invention when a cyclic solution mining technique is used to treat the ore. In such cases the sodium chloride tends to remain in the subterranean mine cavity and does not precipitate during surface operations where it is deliberately maintained in the process solutions in an unsaturated state.

When amounts of salt (NaCl) in the $NaHCO_3$-containing ore exceed 10% by weight, however, recovery of alkali values will typically be substantially diminished by the presence of salt in the separated solution, and very high concentrations of salt in the separated solution may result in salt precipitating concurrently with alkali recovery from such solution. Use of fresh aqueous ammonia solvent, in lieu of regenerated and recycled solvent, is therefore desirable when recovering alkali values from $NaHCO_3$-containing ores highly contaminated with salt.

The aqueous ammonia solvent is desirably prepared directly or indirectly from the aqueous solution which remains after alkali values have been recovered, specifically the mother liquor remaining after recrystallization and separation of the solid alkali product. The aqueous ammonia solvent may alternatively be prepared by introduction of ammonia into water or an aqueous solution. The ammonia may be introduced in either gaseous or liquid form or as an aqueous solution.

Upon startup of the cyclic embodiments of this invention, an aqueous solution containing the proper amount of ammonia may be employed as the initial aqueous ammonia solvent until sufficient solvent can be regenerated and recycled as described below.

The solubilization of the $NaHCO_3$-containing ore and concurrent sodium bicarbonate neutralization with the aqueous ammonia solvent may be performed at temperatures ranging from about 15° C. to 60° C. Temperature, while important with regard to the rate of solubilization and/or neutralization, is not a factor which is critical to the successful practice of this invention. Higher temperatures, which improve solubilization, are feasible but may require the use of higher than conventional pressures (above atmospheric) to minimize evaporative losses of ammonia. Lower temperatures are workable but provide no advantages and may increase the likelihood of the alkali values precipitating as sodium carbonate heptahydrate or decahydrate.

The solubilization and neutralization of the $NaHCO_3$-containing ore with aqueous ammonia solvgent is preferably achieved at a temperature of about 20° to 80° C., with 30°-45° C. being most preferred. The desired temperature for the solubilization and neutralization is ordinarily obtained by adjusting the temperature of the aqueous ammonia solvent, which is contacted with the $NaHCO_3$-containing ore.

The neutralization reaction between the $NaHCO_3$-bearing ore, specifically its sodium bicarbonate constituent, and ammonia in the aqueous ammonia solvent is exothermic. The exothermic heat of reaction is advantageous since the most preferred temperature range of 30°-45° C. is therefore more easily maintained.

In embodiments of this invention which involve treatment of subterranean deposits of trona ore via solution mining techniques, the preferred solubilization-neutralization temperature range is readily maintained. This is because the temperature of such subsurface trona ore deposits ranges from about 25° to 40° C. at depths of 1,500-4,000 feet.

The aqueous ammonia solvent employed in the method of this invention is introduced into contact with the $NaHCO_3$-bearing ore by either of two preferred means. Ore which has been mechanically mined by conventional techniques is slurried with the aqueous ammonia solvent in conventional liquid-solid reaction equipment. Sizing of the dry-mined ore is not critical and additional crushing operations to reduce the size of the as-mined ore are necessary only to the extent dictated by the requirements and capacity of the reaction equipment.

In a preferred alternative embodiment, the subterranean deposits of $NaHCO_3$-bearing ore are contacted in situ with the aqueous ammonia solvent through solution mining techniques conventionally used with other minerals. One or more wells may be used, with separate injection and withdrawal wells preferably being employed when trona ore is the $NaHCO_3$-bearing ore, the two types of wells being located from a few hundred to a thousand feet apart and connected via underground fractures in the trona formation through which the aqueous ammonia solvent may pass.

The aqueous ammonia solvent must be maintained in contact with the subterranean $NaHCO_3$-containing ore deposit for sufficient time to allow for solubilization of at least a portion of the ore. The aqueous ammonia solvent is desirably maintained in contact with such $NaHCO_3$-containing ore until the resulting solution has essentially reached at least 50% of the theoretically obtainable saturation concentration with respect to the ore. More preferably, the residence time, the period over which the aqueous ammonia solvent is maintained in contact with the ore, is sufficient for the withdrawn mining solution to reach at least 70-80% or more of saturation with respect to the ore.

The situation in which $NaHCO_3$-bearing ore is contracted with aqueous ammonia solvent via solution mining techniques must rely on natural convection and diffusion mechanisms to effect solubilization of the ore. Although the residence time of the solvent in contact with the subterranean ore deposit will be longer than with dry-mined ore in an agitated reaction vessel, the lack of good mechanical mixing usually prevents the formation of a substantially saturated solution.

The solubilization and neutralization of the $NaHCO_3$-bearing ore with the aqueous ammonia solvent is ordinarily quite rapid when mechanically-mined ore is treated in a liquid-solid reaction apparatus provided with a mixing means to agitate the slurry. In such a situation, an essentially saturated solution (over 90% of saturation with respect to the ore) is formed in a relatively short time, within an hour. The exact time depends on temperature employed, sizing of the solid ore, degree of mixing, type of reaction apparatus and similar factors.

In operations which involve contacting mechanically mined ore with aqueous ammonia solvent, the relative amounts of the two are desirably adjusted so as to solubilize all of the ore being contacted, leaving only a residue of insoluble matter from the ore, and to provide a solution which is saturated. The amount of solvent contacted with the ore is desirably controlled so as to result in a solution that is essentially saturated with respect to the soluble portion of the ore.

This procedure for treating dry-mined ore is preferred since maximum utilization of the aqueous ammonia solvent is achieved. After separation of the resulting solution from the undissolved, insoluble portion of the ore, the latter may be discarded since no unrecovered soluble alkali values are contained in this residue.

After the solution has been contacted with the $NaHCO_3$-bearing ore for a sufficient period of time, it is separated from the undissolved portion of the ore. For mechanically-mined ore, separation of the solution is generally effected through use of a separator-clarifier or centrifuge to separate the insolubles plus undissolved ore, if any, from the resulting solution. In solution mining of $NaHCO_3$-containing ore, the solution is generally withdrawn from the underground mine cavity by pumping. Most of the insoluble solids will tend to remain in the mine cavity so at most only a simple filtration may be needed to separate any remaining particulates from the withdrawn solution.

The alkali values contained in the separated solution may be recovered and/or utilized in any of several ways. The alkali values are preferably crystallized as sodium sesquicarbonate or as sodium carbonate monohydrate. Soda ash may be recovered via drying of crystallized sodium carbonate monohydrate or calcination of crystallized sesquicarbonate to form dense or light soda ash, respectively.

When trona ore is the $NaHCO_3$-bearing ore, the alkali values in the separated solution are preferably recovered as sodium carbonate monohydrate or as sodium sesquicarbonate, either of which may ultimately be recovered as soda ash.

Crystallization of the alkali values as either sodium carbonate monohydrate or sodium sesquicarbonate is preferably effected through the introduction of additional ammonia into the solution as a salting-out agent. The ammonia is desirably introduced into the solution at a temperature of from 20° C. to 50° C. Higher temperatures are feasible but should be performed at increased pressure (above one atmosphere) in order to maintain the desired amounts of ammonia in solution. Temperatures lower than 30° C. are feasible for some solution concentrations but may result in the precipitation of higher hydrates of sodium carbonate, under some circumstances.

The amount of ammonia which should be added to effect crystallization of alkali values depends on the particular alkali species desired as the crystallized product. With reference to FIG. 2, the particular alkali species that is crystallized depends on the region of the phase diagram in which the solution composition is located. Factors which thus affect the amount of salting-out ammonia to be employed include the compositions ($NH_3$, $Na_2O$, and $CO_2$ content) of the mining solution being treated and of the crystallizer mother liquor and the type of crystallization operation (batchwise or continuous).

Sufficient ammonia is desirably added so as to yield a crystallizer mother liquor composition whose x coordinate is greater than 0.6, preferably greater than 0.75 up to about 0.9. Typically, salting-out ammonia is added in amounts of from 1 to 10 moles of ammonia per mole of sodium sesquicarbonate solubilized by the aqueous ammonia solvent.

In the situation where sodium sesquicarbonate is the desired alkali product, the ammonia addition must be controlled so as to yield a crystallizer liquor whose composition (x and z coordinates) lie within the sesquicarbonate region in the phase diagram of FIG. 2. Batchwise sesquicarbonate crystallizations must be operated in a manner which insures that the crystallizer liquor composition remains within the sesquicarbonate region of FIG. 2 at all times during the crystallization procedure.

Continuous sesquicarbonate crystallization operations are preferred since the crystallizer liquor is maintained at a single steady state composition, within the sesquicarbonate region of FIG. 2. The production of only sodium sesquicarbonate is readily assured in such continuous crystallization operations, via control of the respective feed rates of the solution being treated, salting-out ammonia and (optional) carbon dioxide.

In the crystallization of sodium sesquicarbonate via ammonia introduction as described above, enhanced recoveries of sesquicarbonate may be obtained through the addition of carbon dioxide. The effect of the $CO_2$ addition is to maintain the composition of the crystallizer liquor in the sesquicarbonate region as increased amounts of ammonia are added to salt-out alkali values as sesquicarbonate. As is evident from FIG. 2, the continued addition of ammonia ($x=1.0$, $z=0$) will eventually cause the composition of the treated solution to pass from the sesquicarbonate region into the monohydrate region.

The carbon dioxide may be added either as $CO_2$ or in the form of (sodium or ammonium) bicarbonate. It is preferably added to the crystallizer, simultaneous with the ammonia addition (either as separate streams or combined), or may be introduced into the mining solution as needed prior to crystallization.

Carbon dioxide for this purpose may be obtained from the calcination of sodium sesquicarbonate, if soda ash is being recovered as the ultimate alkali product.

Sufficient $CO_2$ is desirably added along with the requisite $NH_3$, in a preferred continuous sesquicarbonate crystallizer operated at a temperature of about 30°–40° C., to provide a crystallizer liquor composition whose x coordinate is about 0.75–0.85 and whose z coordinate value is such that the x and z coordinates lie within the sesquicarbonate region of the FIG. 2 phase diagram.

A preferred sodium sesquicarbonate crystallizer liquor composition in a continuous crystallizer operation contains 17.9% $NH_3$, 4.0% $Na_2O$, and 6.5% $CO_2$, with the corresponding x, z and h coordinates being 0.89, 0.12 and 2.4 respectively.

In the case where sodium carbonate monohydrate is desired as the crystallized alkali species, sufficient ammonia must be added to the mining solution to shift the liquor composition from the sesquicarbonate region into the monohydrate region shown in FIG. 2.

Continuous sodium carbonate monohydrate crystallizers can be operated with monohydrate as the exclusive crystal product, provided that the crystallizer liquor contains sufficient ammonia to maintain its composition in the monohydrate region of the phase diagram in the figure. A preferred crystallizer liquor composition, in a continuous operation designed to yield sodium carbonate monohydrate, contains 18.5% $NH_3$, 3.1% $Na_2O$ and 4.4% $CO_2$ with its corresponding x, z and h coordinates being 0.92, 0.08 and 2.5, respectively.

A similar ammonia salting-out technique may be employed with solutions derived from $NaHCO_3$-bearing ores other than trona, and the crystal species being precipitated will depend on the particular composition of the solution being treated, i.e., its location in the phase diagram of FIG. 2.

The use of ammonia as a salting-out agent has several advantages. Since ammonia is already being employed as the solubilization agent in the aqueous ammonia solvent, the solution is not being contaminated with a different, new chemical species. Ammonia is an extremely effective salting-out agent and allows high recovery efficiencies to be achieved. The use of ammonia as a salting-out agent allows low crystallization temperatures, i.e., 30°–40° C., to be used without sacrifice in recovery efficiency. Furthermore, even when the solution has a relatively high sodium chloride content, the ammonia functions effectively as a salting-out agent which is selective as to the preferred alkali values.

The ammonia introduced into the solution for inducing crystallization does not appear to be chemically bound in the solution: it exhibits the characteristics of "free" ammonia in solution, i.e., it behaves much like ammonia introduced into water. Consequently, the salting-out ammonia may be readily recovered after the crystals have been separated from the mother liquor. Ammonia recovery from the mother liquor may be effected by evaporation under partial vacuum or distillation at a moderately high temperature, e.g., 60° C. or above or by other conventional ammonia recovery techniques.

The ammonia gas mixture initially recovered from the mother liquor, when $NH_3$ recovery is effected in a batch operation at elevated temperature, is ordinarily rich in ammonia and substantially free of carbon dioxide. This ammonia is desirably recovered from the mother liquor for recycle and reuse, preferably as salting-out ammonia in the crystallization operation. Ammonia recovered in latter stages of the $NH_3$ recovery operation may contain $CO_2$ in concentrations which must first be removed prior to reuse of the ammonia, unless $CO_2$ is also being introduced into the crystallizer along with the salting-out ammonia.

The crystallization of alkali values such as sodium sesquicarbonate and sodium carbonate monohydrate may also be performed via evaporative removal of water from the solution, at temperatures of from about 30° to 110° C. Crystallization may also be induced by changing the temperature of the solution. This is an especially advantageous procedure for recovering sodium carbonate monohydrate from solutions also containing substantial amounts of dissolved NaCl, since sodium carbonate monohydrate solubility varies inversely with temperature and sodium chloride solubility varies directly with temperature.

Sodium sesquicarbonate may also be recovered from a solution containing dissolved alkali values, under certain circumstances, by the removal of ammonia originally introduced via the aqueous ammonia solvent. When an aqueous ammonia solvent containing about 2% by weight $NH_3$ is employed to solubilize sesquicarbonate from trona ore, removal of this ammonia from the resulting saturated solution has the effect of decreasing sodium sesquicarbonate solubility and causing it to crystallize from solution.

This effect is better understood by reference to FIG. 1 which illustrates that maximum sesquicarbonate solubility is achieved with about 2% $NH_3$ in an aqueous ammonia solvent. Either more ammonia or less ammonia in such a solution saturated with respect to sesquicarbonate causes a decrease in sesquicarbonate solubility.

Removal of the ammonia from the solution containing dissolved alkali values is readily accomplished by elevating the solution temperature and/or by conventional evaporative techniques under partial vacuum. Sodium sesquicarbonate may thereafter be recovered by cooling the $NH_3$-free solution at least to the temperature at which the sodium sesquicarbonate was solubilized with the aqueous ammonia solvent. Aqueous ammonia solvent is desirably regenerated from the mother liquor which remains after recovery of the solids by reintroducing the ammonia removed earlier.

Crystalline species other than sodium sesquicarbonate, e.g., sodium bicarbonate, may be recovered utilizing this technique when the composition of the solution being treated lies or is shifted into a non-sesquicarbonate region of the phase diagram shown in FIG. 2.

In preferred embodiments of the invention, the mother liquor which remains after separation of the crystallized alkali values is desirably treated as necessary to regenerate aqueous ammonia solvent. The regenerated aqueous ammonia solvent is then recycled to recover alkali values from more $NaHCO_3$-bearing ore. An advantage of the aqueous ammonia solvent for solubilizing and neutralizing $NaHCO_3$-bearing ores is that it is readily regenerated after alkali values have been recovered from the resulting solution and the solution recycled as aqueous ammonia solvent.

Regeneration of the aqueous ammonia solvent ordinarily requires that additional ammonia and water be added to the mother liquor. In cyclic methods that involve solution mining, compensation must be made for losses of solvent which occur as solvent replaces dissolved $NaHCO_3$-containing ore in the subterranean mine cavity. This "inventory" of solvent is typically allowed to accumulate as the cavity enlarges through dissolution of ore and is not normally recovered in short-term operations.

Minor amounts of ammonia and water are typically lost as process losses during the cyclic operation of this invention, and these should also be made up during regeneration of the aqueous ammonia solvent.

Ammonia and water which are removed from solution during evaporative crystallization of alkali values should be restored to the aqueous ammonia solvent during regeneration.

In preferred cyclic embodiments of the invention which crystallize alkali values through the addition of ammonia, the salting-out ammonia is ordinarily removed from the mother liquor prior to or during regeneration of the aqueous ammonia solvent. After removal of the salting-out ammonia, typically by distillation, the treated mother liquor should contain a residual amount of ammonia that corresponds to that required for the aqueous ammonia solvent.

When sodium sesquicarbonate is being recovered as the crystallized alkali product from trona ore, regeneration of aqueous ammonia solvent as described above is ordinarily sufficient to provide a satisfactory solvent. The regenerated aqueous ammonia solvent will contain the proper amount of ammonia and contain amounts of dissolved $Na_2O$ and $CO_2$ which yield x and y coordinates lying within the sesquicarbonate region of the phase diagram shown in FIG. 2. The solvent, after dissolution of more trona, will yield a solution from which sodium sesquicarbonate can be recovered through the addition of salting-out ammonia in a repetition of the cycle of recovery.

When sodium carbonate monohydrate is being recovered as the crystallized alkali product from trona ore, regeneration of the aqueous ammonia solvent requires removal of carbon dioxide in addition to the mother liquor treatment procedures outlined above. The mother liquor that results after crystallization of sodium carbonate monohydrate has a high bicarbonate (carbon dioxide) content. Removal of a portion of the mother liquor's carbon dioxide content is required to provide the proper $CO_2$ content in the regenerated aqueous ammonia solvent. Sufficient $CO_2$ is removed, and the amounts of $NH_3$ and $Na_2O$ are adjusted, to yield a regenerated aqueous ammonia solvent whose x and y coordinates correspond to that of the previously recycled aqueous ammonia solvent.

The interaction of the aqueous ammonia solvent with the $NaHCO_3$-bearing ore, which is believed to involve a neutralization reaction in which the $NaHCO_3$ portion of the ore is converted to a more soluble carbonate, apparently results in a portion of the ammonia in the solvent being chemically bound to carbon dioxide as a byproduct of this reaction. The carbon dioxide is thus believed to be present in the mother liquor as an ammonium carbonate, ammonium bicarbonate and/or ammonium carbamate.

Regeneration of aqueous ammonia solvent from such mother liquor requires that the ammonium carbonate/-bicarbonate compounds be decomposed to remove the carbon dioxide from the solution, which concurrently liberates the ammonia.

Removal of the carbon dioxide from the mother liquor is ordinarily accomplished by thermally decomposing the ammonium carbonate/bicarbonate compounds in the mother liquor. Decomposition at moderate to high temperature results in the formation of a gas mixture containing carbon dioxide, ammonia and water.

The carbon dioxide in the $NH_3$–$CO_2$ gas mixture may be separated by conventional gas separation techniques, e.g., the Wentworth process ($CO_2$ absorption via monoethanolamine). Such procedures involve washing the gas mixture with a liquid which absorbs $CO_2$. The scrubbed gas mixture, $CO_2$-free ammonia, may then be reintroduced into the treated mother liquor. The absorbed $CO_2$ gas is recovered from the scrubbing liquid, to be discarded or used, as desired.

After the carbon dioxide has been separated from the $NH_3$-containing gas mixture, the $CO_2$-free ammonia mixture is preferably restored to the mother liquor in order to yield a regenerated aqueous ammonia solvent containing the requisite $NH_3$, $Na_2O$ and $CO_2$. The pH of the regenerated aqueous ammonia solvent is preferably maintained in the range of about 9.7 to 10.2, which ensures that a substantial portion of the ammonia in solution is present as "free" ammonia available for further enhanced solubilization and neutralization of the $NaHCO_3$ portion of ores like trona.

In embodiments in which the $NaHCO_3$-bearing ore is being treated as dry-mined ore in surface operations, the dry-mined ore may first be slurried with the $CO_2$- and $NH_3$-free mother liquor and the recovered ammonia ($CO_2$-free) added directly to the slurry, to form the desired aqueous ammonia solvent composition. The solution obtained from such a procedure is identical to that which results when trona is contacted with aqueous ammonia solvent in the usual manner.

The aqueous ammonia solvent, after being regenerated from the mother liquor, is reused to treat additional $NaHCO_3$-containing ore, and the entire cycle of recovery is repeated.

The crystallized alkali values, after their separation from the mother liquor, are desirably dried by conventional methods to form soda ash. Sodium carbonate monohydrate may be dried to form dense soda ash. Sodium sesquicarbonate may be calcined to form light soda ash or, alternatively, may simply be dried to recover a relatively pure sodium sesquicarbonate product.

The method of this invention is illustrated by the following examples. Unless otherwise indicated, all percentages are by weight.

The apparatus employed in Examples 1–4 and 6–9 consisted of a water-jacketed 1 liter round bottom flask equipped with a stirrer and an electrode for measuring pH and a thermistor for measuring temperature.

EXAMPLE 1

Example 1 demonstrates the recovery of sodium carbonate monohydrate from sodium sesquicarbonate in a cyclic procedure.

Into the flask were added 200 g (0.9 g-mole) solid sodium sesquicarbonate and 473 g water. Only a portion of the solids dissolved, resulting in a slurry containing about 11% solids, based on the slurry weight. The slurry pH was about 9.7.

Gaseous ammonia was bubbled through the slurry, at a temperature of 45° C., until all of the solid sodium sesquicarbonate had dissolved. The resulting solution, which weighed 687 g, was then analyzed. Analysis indicated the solution was saturated and contained (weight basis) about 12.0% $Na_2O$ (equivalent to 20.5% $Na_2CO_3$), 12.2% $CO_2$ and 2.0% $NH_3$ (0.8 g-mole). The $Na:CO_2$ mole ratio of the liquor was therefore about 1.40:1; its x, z and h coordinates were 0.23, 0.55 and 7.5 respectively.

The solution was then treated with ammonia gas at a temperature of 45° C. to effect crystallization of sodium carbonate monohydrate. Ammonia was introduced into the solution over a 6 hour period; crystals began to appear near the start of the ammoniation.

The product crystals in the resulting slurry were separated from the mother liquor by filtration and air-dried at room temperature to constant weight. Analysis of the dry crystals indicated 98% pure sodium carbonate monohydrate. The mother liquor analysis indicated the solution contained 5.2% $Na_2O$ (equivalent to 9% $Na_2CO_3$), 7.4% $CO_2$ and 18.3% $NH_3$ (7.2 g-mole). The $Na:CO_2$ mole ratio of the solution had therefore been reduced to about 1.01:1; its x, z and h coordinates were 0.86, 0.14 and 2.2 respectively.

The mother liquor was next treated to remove the ammonia. The mother liquor was heated to a temperature of 60° C. and nitrogen bubbled through the solution to promote ammonia removal. After most of the salting-out ammonia had been removed, the solution composition analyzed as 5.5% $Na_2O$ (equivalent to 9.4% $Na_2CO_3$), 7.2% $CO_2$, and 3.0% $NH_3$, corresponding to x=0.50, z=0.46 and h=12.4.

Nitrogen addition at 60° C. was continued until the solution analysis indicated that nearly all the $NH_3$ had been removed. Loss of some water and $CO_2$ occurred concurrently with the $NH_3$ removal. At this point, the solution analyzed as 5.7% $Na_2O$ (equivalent to 9.8% $Na_2CO_3$), 5.1% $CO_2$ and 0.2% $NH_3$, corresponding to x=0.06, z=0.60 and h=24.9. Its sodium bicarbonate concentration was analyzed as 3.1% $NaHCO_3$, so only 8.2% $Na_2CO_3$ was actually present in the solution.

The entire cycle of dissolving and recovery was repeated. In lieu of the de-ammoniated mother liquor obtained above, a freshly prepared solution corresponding to the mother liquor composition ($NH_3$-free) was used.

The solution therefore contained 3.1% $NaHCO_3$ and 8.2% $Na_2CO_3$; its weight was 159 g. To this solution was added 33 g solid sodium sesquicarbonate. The solubilization and neutralization procedures used previously were repeated, as was the ammonia salting-out procedure.

A total of 36.2 g wet crystals were recovered and air dried. The air dried crystals analyzed as 97% pure sodium carbonate monohydrate. The mother liquor recovered weighed 152 g, and its analysis indicated 5.9% $Na_2O$ (equivalent to 10.2% $Na_2CO_3$), 7.3% $CO_2$ and 13.6% $NH_3$. The analysis indicated a lesser degree of ammoniation in this second cycle. The Na:$CO_2$ mole ratio of the mother liquor was 1.15:1; its x, z and h coordinates were 0.81, 0.17 and 3.2 respectively.

EXAMPLE 2

Example 2 demonstrates the recovery of sodium carbonate monohydrate from sodium sesquicarbonate which is salt-contaminated. The procedures of the first example were repeated in Example 2, using a sodium sesquicarbonate slurry which also contained about 10% by weight NaCl. The major difference appeared to be that larger volumes of process liquor are required to dissolve the same quantity of salt-contaminated sodium sesquicarbonate and recover the same amount of sodium carbonate monohydrate as when salt-free sodium sesquicarbonate is used.

The sodium sesquicarbonate slurry contained 125 g (0.55 g-mole) sodium sesquicarbonate, 67.5 g NaCl (10% NaCl) and 495.5 g water for a total slurry weight of 688 g.

Solubilization and neutralization of the sodium sesquicarbonate slurry, using the same procedures as used previously, resulted in a solution containing 6.9% $Na_2O$ (equivalent to 11.8% $Na_2CO_3$), 9.8% NaCl, 6.6% $CO_2$ and 2.7% $NH_3$ (1.1 g-mole), corresponding to x=0.29, y=0.70, z=0.39 and h=7.0.

Salting-out of the sodium carbonate monohydrate with ammonia was performed in the same manner followed in Example 1.

The mother liquor recovered after separation of the product crystals weighed 562 g and contained 2.4% $Na_2O$ (equivalent to 4.1% $Na_2CO_3$), 10.5% NaCl, 3.9% $CO_2$ and 14.6% $NH_3$ (4.8 g-mole). Its x=0.77, y=0.84, z=0.09 and h=2.6.

The solid product recovered after crystallization, weighing 102 g, was air-dried as previously but was not washed. A total of 69 g dry solids was recovered, of which 89% was sodium carbonate monohydrate and 7.4% was sodium chloride.

The significant amount of mother liquor present in the wet recovered solids and the absence of water washing of the wet solids probably account for the high proportion of salt contained in the dried product.

Comparison of the results from Examples 1 (saltfree) and 2 (salt-containing) indicates that, if equivalent yields of sodium carbonate monohydrate are desired, then the volume of salt-containing (10% NaCl) solution stream being circulated will be almost two-thirds larger than the corresponding solution stream in the NaCl-free process.

EXAMPLE 3

Example 3 demonstrates the recovery of sodium sesquicarbonate in a cyclic method.

The flask was charged with an aqueous slurry consisting of 23% by weight sodium sesquicarbonate and 9% sodium bicarbonate, prepared from 236.9 g sesquicarbonate, 93.8 g $NaHCO_3$ and 701.4 g water. The slurry had a pH of 8.7.

Gaseous ammonia was introduced into the slurry, whose temperature was maintained at about 45° C., to promote dissolution of the undissolved solids. Ammonia addition was continued until the solution pH had reached 9.3; no solids remained undissolved.

Analysis of the solution indicated 12.4% $Na_2O$ and 12.7% $CO_2$ (equivalent to 24% sodium sesquicarbonate and 6.8% $NaHCO_3$) and 3.7% $NH_3$ (2.1 g-mole). The solution Na:$CO_2$ mole ratio was therefore about 1.36:1; its x, z and h coordinates were 0.35, 0.47 and 5.7 respectively.

Sodium sesquicarbonate was crystallized from this solution by introducing gaseous ammonia into it as a salting out agent. The temperature of the mixture was maintained at about 45° C. during the ammonia addition, which lasted three hours. The pH of the resultant slurry was 10.8.

The solids were separated from the mother liquor by filtration, a total of 242 g wet cake and 716.6 g mother liquor being collected. The mother liquor analyzed as 5.9% $Na_2O$, 7.0% $CO_2$ and 13.9% $NH_3$ (5.9 g-mole) and thus had an Na:$CO_2$ mole ratio of 1.21:1. Its x, z and h coordinates were 0.81, 0.16 and 3.1 respectively.

The wet cake analyzed as 26.3% $Na_2O$, 26.6% $CO_2$ and 3.2% $NH_3$ and thus had an Na:$CO_2$ mole ratio of 1.4:1. The wet cake was air dried at room temperature and analyzed as 99% pure sodium sesquicarbonate.

The mother liquor, weighing 716.6 g, was treated to remove its ammonia by sparging it with nitrogen at a temperature of 45° C. for a period of four hours. The solution pH dropped from an initial value of 10.8 to a final value of 9.5. After this removal of most of the salting-out ammonia, the solution weighed 600 g and analyzed as 7.1% $Na_2O$, 7.5% $CO_2$ and 3.6% $NH_3$ (1.3 g-mole). The x, z and h coordinates were 0.48, 0.39 and 9.5 respectively. The analysis indicated that some $CO_2$ had been removed concurrently with the ammonia.

The cycle of dissolving and recovery was then repeated. In lieu of the substantially de-ammoniated mother liquor obtained above, a freshly prepared solution was employed whose composition corresponded to that of the actual mother liquor ($NH_3$-free). The solution therefore contained 13.6% sodium sesquicarbonate and 4.3% $NaHCO_3$.

An aqueous slurry was prepared, which consisted of 133.0 g sodium sesquicarbonate and 62.7 g $NaHCO_3$, added to 969.5 g of the mother liquor solution described above. The pH of the slurry was 8.7.

The slurry was ammoniated, as previously, with gaseous ammonia to solubilize all solids in the slurry. The pH of the resulting solution was 9.3. The solution analyzed as 12.0% $Na_2O$, 11.9% $CO_2$ (equivalent to 23.3% sodium sesquicarbonate and 2.8% $NaHCO_3$) and 4.8% $NH_3$. Its Na:$CO_2$ mole ratio was therefore 1.42:1, and its x, z and h values were 0.42, 0.40 and 5.2 respectively.

Ammonia was introduced into this solution to saltout product crystals, over a period of about four hours. The pH of the resulting slurry was about 10.0 after all ammonia had been added.

The slurry was separated by filtration and yielded 187.2 g wet cake and 737.9 g mother liquor. The mother liquor analyzed as 7.4% $Na_2O$, 7.9% $CO_2$ and 11.4% $NH_3$. Its Na:$CO_2$ mole ratio was therefore 1.33:1, and its x, z and h values were 0.74, 0.20 and 3.6 respectively.

The wet solids analyzed as 33.3% $Na_2O$, 31.9% $CO_2$, and 1.6% $NH_3$, with the Na:$CO_2$ mole ratio being 1.48:1. The analysis indicated that the air-dried product was sodium sesquicarbonate of greater than 99%+ purity.

EXAMPLE 4

The following example demonstrates the effect of the carbon dioxide content of a solution in the crystallization of alkali values as either sodium sesquicarbonate or sodium carbonate monohydrate.

The substantially de-ammoniated mother liquor obtained after the first sesquicarbonate crystallization described in Example 3 was used to prepare a sodium sesquicarbonate slurry. No sodium bicarbonate was added to the slurry.

The slurry consisted of 180 g sodium sesquicarbonate and 105 g water added to 600 g of the mother liquor, which liquor contained 7.1% $Na_2O$, 7.5% $CO_2$ and 3.6% $NH_3$. Its x, z and h values were 0.48, 0.39 and 9.5 respectively.

The slurry was ammoniated as in previous Examples. The pH of the slurry was controlled via the amount of ammonia introduced such that a final pH of 10.1 was achieved. Not all of the solid sesquicarbonate dissolved; 55 g of dry sodium sesquicarbonate was recovered, which indicated that 125 g of the initial 180 g charge had been solubilized.

The solution, after separation from the undissolved solids, analyzed as 10.6% $Na_2O$, 10.6% $CO_2$ and 5.8% $NH_3$. Its Na:$CO_2$ ratio was therefore 1.43:1, and its x, z and h values were 0.50, 0.35 and 5.2 respectively.

The solution was then treated with additional ammonia to salt-out a crystalline product. Ammonia was added until the pH of the mixture reached 11.0.

The product slurry was separated by filtration, 106 g cake and 840 g mother liquor being recovered. The wet cake was air-dried to yield 74.3 g dry product, which analyzed primarily as sodium carbonate monohydrate, 87% $Na_2CO_3.H_2O$, and 6.7% sodium sesquicarbonate.

EXAMPLES 5A AND 5B

Examples 5A and 5B simulate the recovery of sodium sesquicarbonate from salt-free trona ore with an aqueous ammonia solvent.

The apparatus for these examples consisted of a vertical glass column, 10.2 cm diameter and 110 cm in length, stoppered at both ends. The glass column was charged with 3000 g powdered salt-free Wyoming trona ore, which filled the tube to a depth of about 35 cm.

Aqueous ammonia solvent was introduced at a metered rate via a feed tube whose outlet was located at the base of the glass column at its perimeter. Solution was withdrawn at a similar rate from a point at the base of the column at the center, and was passed through glass wool to filter out particulates. The trona ore in the glass column was kept covered with solvent at all times by use of an overflow device.

The aqueous ammonia solvent contained 2% $NH_3$ by weight for both Example 5A and 5B. The aqueous ammonia solvent was metered at a rate, for both examples, of about 1 ml/minute. Residence time in the column was approximately 10 hours. The solvent temperature in both examples was 35° C.

In Example 5A, solution was withdrawn and collected after an initial 16 hours of operation to reach steady state. For Example 5A, 330 g solution was collected. For Example 5B, the subsequent 369 g solution was collected.

Analyses of the alkali solution were similar for both examples. The Example 5A solution was not fully saturated with respect to the trona ore and contained 10.6% $Na_2O$, 10.3% $CO_2$ and 1.9% $NH_3$, with x, z and h coordinates being 0.25, 0.51 and 8.8 respectively. The Example 5B solution was likewise unsaturated and contained 9.5% $Na_2O$, 8.9% $CO_2$ and 1.4% $NH_3$, with its x, z and h coordinates being 0.21, 0.52 and 10.8 respectively. The Na:$CO_2$ mole ratio of both solutions was 1.5:1.

The first batch of alkali solution, 330 g, was ammoniated at a temperature of 35° C. with anhydrous ammonia for a period of 5.5 hours to effect crystallization of its alkali values as sodium sesquicarbonate. The pH of the solution was initially 9.9 and at the end of the ammoniation, the slurry pH was 11.5 The ammoniation of the second batch of solution, 369 g, was performed at a temperature of 28° C. and lasted for two hours. The initial solution pH was 10.0, and at the end of ammoniation, the slurry pH was 11.5.

The solids in both batches were separated from the mother liquor and were air-dried without washing. The recovered solids analyzed as at least 90% pure sodium sesquicarbonate in both cases, about 25 g being obtained for 5A and 27 g for 5B.

The mother liquor in each case was also recovered and analyzed. For 5A, the mother liquor, 313 g, analyzed as 6.5% $Na_2O$, 6.1% $CO_2$ and 13.2% $NH_3$, with x, z and h coordinates being 0.79, 0.14 and 3.3. For 5B, the mother liquor, 349 g, analyzed as 4.3% $Na_2O$, 3.9% $CO_2$ and 9.0% $NH_3$, with x, z and h coordinates being 0.79, 0.13 and 6.0 respectively.

EXAMPLE 6

Example 6 illustrates the recovery of sodium sesquicarbonate and sodium carbonate monohydrate from saltfree trona ore with an aqueous ammonia solvent. The alkali solution of this example was ammoniated batchwise in three stages, sodium sesquicarbonate being recovered in the first stage and sodium carbonate monohydrate being recovered in the latter two stages.

An aqueous ammonia solvent was prepared by combining 20.4 g of 29.8% aqueous ammonia solution with 182.1 g $H_2O$, the solvent thus containing 3.0% $NH_3$.

Powdered trona ore, 158 g, was added to the solvent, 202 g, at a temperature of 30° C. and mixed for one and half hours. About 70% of the trona dissolved, the undissolved portion, 44 g, being separated from the alkali solution by filtration to yield 247 g alkali solution. The alkali solution had a pH of 10.0 and analyzed as 11.3% $Na_2O$, 10.9% $CO_2$ and 2.0% $NH_3$, with x, z and h coordinates of 0.24, 0.51 and 8.1 respectively. Its $Na:CO_2$ mole ratio was 1.47:1.

The alkali solution was ammoniated at a temperature of 30° C. with anhydrous ammonia to crystallize alkali values from solution as sodium sesquicarbonate. Ammoniation was continued for about 3.5 hours, until the slurry pH had reached 11.9, and the slurry was stirred for an additional hour without ammoniation.

The solids which were separated from the mother liquor were air-dried without washing to yield about 27 g solids. The recovered solids analyzed as 92% sodium sesquicarbonate and 8% sodium carbonate monohydrate.

About 196 g mother liquor was recovered, which analyzed as 7.7% $Na_2O$, 7.5% $CO_2$ and 10.8% $NH_3$, with x, z and h coordinates being 0.72, 0.19 and 3.8 respectively.

The mother liquor was ammoniated further for 35 minutes to yield additional alkali values, as sodium carbonate monohydrate. The pH at the end of this ammoniation was 11.9.

The solids were separated from the mother liquor and air-dried without washing to yield about 9 g solids. The recovered solids analyzed as 95% sodium carbonate monohydrate. The mother liquor, weighing 168 g, analyzed as 4.7% $Na_2O$, 5.3% $CO_2$ and 18.1% $NH_3$, corresponding to x, z and h values of 0.87, 0.10 and 2.4 respectively.

The mother liquor was ammoniated further for 2 hours to yield additional sodium carbonate monohydrate. The slurry pH after this ammoniation was 12.2.

The solids separated from the mother liquor were air-dried, yielding about 8 g solids. The recovered solids analyzed as 97% sodium carbonate monohydrate. The mother liquor, weighing 152 g, analyzed as 2.5% $Na_2O$, 3.5% $CO_2$, 21.2% $NH_3$, corresponding to x, z and h values of 0.94, 0.06 and 2.1 respectively.

EXAMPLE 7

Example 7 illustrates the recovery of sodium sesquicarbonate utilizing an aqueous ammonia solvent which contains both ammonia and carbon dioxide, the latter as sodium bicarbonate. The example was performed in the same apparatus as used for Example 6.

The aqueous ammonia solvent was prepared by combining 42 g of 29.8% aqueous $NH_3$ solution, 20 g $NaHCO_3$ and 152 g $H_2O$. The solvent thus contained 3.4% $Na_2O$, 4.9% $CO_2$ and 5.8% with x, z and h coordinates of 0.76, 0.25 and 9.7 respectively.

Powdered sodium sesquicarbonate, 58 g was added to the solvent 214 g at a temperature of 31.5° C. to form an alkali solution. The alkali solution had a pH of 10.2 and analyzed as 10.6% $Na_2O$, 10.4% $CO_2$ and 3.6% $NH_3$ with x, z and h values of 0.38, 0.43 and 6.9 respectively.

The alkali solution was ammoniated at a temperature of 35° C. with anhydrous ammonia for three hours to effect crystallization of the alkali values as sodium sesquicarbonate. The pH of the slurry at the end of ammoniation was 11.5.

The solids separated from the mother liquor were air-dried, yielding 16 g solids. The recovered solids analyzed to 90% sodium sesquicarbonate and 10% sodium carbonate monohydrate.

About 262 g mother liquor was recovered, which analyzed as 7.5% $Na_2O$, 7.3% $CO_2$ and 10.6% $NH_3$, with x, z and h values of 0.72, 0.19 and 3.9 respectively.

EXAMPLE 8

Example 8 is a duplicate of Example 7, except for ammoniation conditions used to recover the alkali solids.

In this example, 54 g powdered sodium sesquicarbonate (vs. 58 g in Example 7) was added to 214 g of aqueous ammonia solvent (prepared as in Example 7) at a temperature of 35° C. The resultant alkali solution had a pH of 10.8 and contained 10.8% $Na_2O$, 10.2% $CO_2$ and 4.2% $NH_3$, with x z and h values of 0.42, 0.39 and 6.3 respectively.

The alkali solution was ammoniated at a temperature of 40° C. (vs. 35° C. in Example 7) with anhydrous ammonia for five hours (vs. three hours in Example 7) to effect crystallization of the alkali values as sodium sesquicarbonate. The pH of the slurry at the end of ammoniation was 11.3.

Solids separated from the mother liquor were air-dried, yielding 29 g solids (vs. 16 g in Example 7). The substantially larger yield in this example, as compared with Example 7, appeared due to the larger amount of salting-out ammonia introduced into solution (as evidenced by the mother liquor $NH_3$ analyses).

The recovered solids analyzed at 90% sodium sodium sesquicarbonate and 10% sodium carbonate monohydrate. About 251 g mother liquor were recovered, which analyzed as 6.0% $Na_2O$, 6.4% $CO_2$ and 14.6% $NH_3$, with x, z and h values of 0.82, 0.14 and 3.0 respectively.

EXAMPLE 9

Example 9 demonstrates a cyclic method for recovering sodium sesquicarbonate in the presence of salt.

Aqueous ammonia solvent containing 1.6% $Na_2O$, 2.6% $CO_2$, 4.0% $NH_3$ and 10.0% NaCl was prepared by mixing the following salts and ammonium hydroxide in water: $Na_2CO_3$ (2.65%), $(NH_4)_2CO_3$ (2.40%), $NH_4HCO_3$ (0.78%), NaCl (10.0%), 29% $NH_4OH$ (10.2%) and water (74.0%). The $Na:CO_2$ mole ratio of the solvent was 0.83:1. Its x, y, z and h coordinates were 0.52, 0.63, 0.21 and 9.7 respectively.

One thousand grams of aqueous ammonia solvent was mixed with 176 g sodium sesquicarbonate at a temperature of 35° C. About 10% of the sesquicarbonate, 17.5 g, remained undissolved after several hours of mixing and was therefore separated from the solution. The alkali solution analyzed as 6.8% $Na_2O$, 7.3% $CO_2$, 3.0% $NH_3$ and 8.6% NaCl, and its x, y z and h coordinates were 0.32, 0.73, 0.42 and 7.4 respectively.

Anhydrous ammonia was added to the solution at a temperature of 35° C. to crystallize sodium sesquicarbonate. The alkali solution initially had a pH of 10.2 and seed crystals of sodium sesquicarbonate (0.11 g) were added when the solution pH reached 10.5. Crystallization proceeded above a pH of 10.9, resulting in a dense slurry, and ammonia addition was continued until the pH of the slurry reached 11.8.

The sodium sesquicarbonate solids were separated from the mother liquor and air-dried without washing, a total of about 204 g being obtained. The solids analyzed as contained 20.1% $Na_2O$, 19.3% $CO_2$ (corresponding to 89% sodium sesquicarbonate), 4.9% $NH_3$ and 6.1% NaCl. The $Na_2O$ analyses indicated that a large percentage of the alkali which had been solubilized was recovered as substantially pure sodium sesquicarbonate. The presence of salt in the dried alkali product appeared due to the absence of any washing of the recovered solids.

The mother liquor, weighing about 965 g, analyzed as 2.2% $Na_2O$, 3.2% $CO_2$, 19.1% $NH_3$ and 8.1% NaCl, with its x, y, z and h coordinates being 0.84, 0.90, 0.06 and 2.7 respectively.

The mother liquor was sparged with $H_2O$-saturated nitrogen gas at a temperature of 35° C. to remove the salting-out ammonia. The sparging was continued until the solution pH had decreased from 11.8 to 10.1. The sparged mother liquor analyzed as 2.2% $Na_2O$, 3.4% $CO_2$, 2.7% $NH_2$ and 9.9% NaCl, with its x, y, z and h coordinates being 0.40, 0.58, 0.34 and 11.1 respectively.

A second cycle was begun by mixing 177 g sodium sesquicarbonate with 769 g of recycled mother liquor as aqueous ammonia solvent. Approximately half of the sesquicarbonate was solubilized, yielding 862 g solution after the undissolved solids were separated from the solution. This alkali solution analyzed as containing 6.8% $Na_2O$, 7.2% $CO_2$, 2.4% $NH_3$ and 8.9% NaCl, with its x, y, z and h coordinates being 0.28, 0.70, 0.45 and 7.8 respectively.

The solution was ammoniated with anhydrous ammonia, as previously, to induce crystallization of sodium sesquicarbonate. Solution pH was 10.1 initially, and ammoniation was continued until the pH of the slurry reached 12.0.

The mother liquor, weighing about 733 g, analyzed as 2.2% $Na_2O$, 3.2% $CO_2$ 16.8% $NH_3$ and 8.4% NaCl, with its x, y, z and h coordinates being 0.82, 0.88, 0.07 and 3.1 respectively.

The solids were air-dried without washing, a total of about 169 g dried solids being obtained. The recovered solids analyzed as 20.8% $Na_2O$, 19.4% $CO_2$ (corresponding to 92% sodium sesquicarbonate), 2.2% $NH_3$ and 5.4% NaCl. As in the first cycle, the recovered alkali product was primarily sodium sesquicarbonate and was contaminated with some salt due to the absence of washing of the recovered solids.

The mother liquor was sparged with $H_2O$-saturated nitrogen gas at a temperature of 35° C. to remove the salting-out ammonia. The sparging was continued until the mother liquor pH had decreased from 12.0 to 10.1. The treated mother liquor, which was deemed suitable for reuse as aqueous ammonia solvent, analyzed as 2.6% $Na_2O$, 3.9% $CO_2$, 2.6% $NH_3$ and 9.9% NaCl, with its x, y, z and h coordinates being 0.38, 0.59, 0.37 and 10.8 respectively.

A soda ash recovery operation based on the procedure described in Example 1 is illustrated by the block flow diagram of the drawing.

Trona ore 1 is contacted with aqueous ammonia solvent 2 to effect solubilization of the ore, shown in the drawing by the block marked "DISSOLVER". The dissolver, in other preferred embodiments, may be eliminated by the solution mining of trona ore in situ with the aqueous ammonia solvent.

After separation of the insolubles from the resulting solution (not shown in the drawing), the solution 3 is passed to a crystallization apparatus ("CRYSTALLIZER"), where it is treated with salting-out ammonia 4 to precipitate sodium carbonate monohydrate from solution.

The slurry 5 exiting from the crystallizer is separated in a centrifuge or other solid-liquid separation apparatus ("CRYSTAL SEPARATOR") into product cyrstals 6 and mother liquor 9.

The product crystals 6 are dried ("DRYER") to form soda ash 7 by removal of the hydrated water 8 from the product crystals.

The mother liquor 9 is treated further, first by removing the salting-out ammonia from the liquor via distillation ("SALT-OUT $NH_3$ RECOVERY"). Ordinarily the salting-out ammonia removed from the mother liquor is $CO_2$-free and may simply be recycled as salting-out ammonia 4 as shown in the drawing.

In order to regenerate aqueous ammonia solvent 2, the mother liquor 10 is distilled further to effect removal of $CO_2$, some ammonia being removed concurrently in the gas mixture ("$NH_3$-$CO_2$ SEPARATION"). The $CO_2$ 11 is separated from the ammonia 12 is the gas mixture and may be reused or discarded, as desired. Ammonia 12 which is separated from the $CO_2$ 11 is utilized to regenerate aqueous ammonia solvent 2 from the $CO_2$-free mother liquor 13 ("AQUEOUS SOLVENT REGENERATION"). Make-up $NH_3$ and water (not shown) are added as needed during aqueous solvent regeneration to compensate for losses of these components during the cyclic operation of the process.

The regenerated aqueous ammonia solvent 2 is then recycled and the cycle of recovery repeated.

A material balance, based on data from the example and on the process flow scheme shown in the drawing, is shown in the accompanying Table I. The basis for the idealized material balance is 100 units (by weight) of soda ash output. Process efficiency is assumed to 100%, i.e., process losses are minimal. Ammonia which is present in solution as various chemical species is shown under the heading "$(NH_4)_2CO_3$" which is intended to include the presence of ammonium bicarbonate and/or carbamate, as well as ammonium carbonate. The compositions of the solution streams in the example are summarized in Table II. The Table lists $Na_2O$, $CO_2$ and $NH_3$ compositions, expressed as percent by weight and corresponding values for the x, z and h coordinates (y=1.0 for all streams).

TABLE I

| Stream Ref. | $Na_2CO_3$ | $NaHCO_3$ | $H_2O$ | $NH_3$ | $(NH_4)_2CO_3$ | $CO_2$ | Total |
|---|---|---|---|---|---|---|---|
| 1 | 66.7 | 52.8 | 22.6 | | | | |
| 2 | 33.3 | | 392 | 10.7 | | | 436.0 |
| 3 | 133.3 | | 415 | | 30.2 | | 578.5 |
| 4 | | | | 93 | | | 93 |
| 5 | 133.3 | | 415 | 93 | 30.2 | | 671.5 |
| 6 | 100 | | 17 | | | | 117 |
| 7 | 100 | | | | | | 100 |
| 8 | | | 17 | | | | 17 |
| 9 | 33.3 | | 398 | 93 | 30.2 | | 554.5 |
| 10 | 33.3 | | 398 | | 30.2 | | 461.5 |
| 11 | | | 12 | | | 13.8 | 25.8 |
| 12 | | | 12 | 10.7 | | | 22.7 |
| 13 | 33.3 | | 380 | | | | 413.3 |

TABLE II

| | Stream Compositions | | | | | |
|---|---|---|---|---|---|---|
| Stream Ref. | $Na_2O$ | $CO_2$ | $NH_3$ | x | z | h |
| 2 | 4.5 | 3.2 | 2.4 | 0.50 | 0.25 | 16.6 |
| 3 | 13.5 | 12.0 | 1.8 | 0.20 | 0.50 | 3.7 |
| 5* | 11.6 | 10.3 | 15.4 | 0.71 | 0.18 | 1.9 |
| 9 | 3.5 | 5.0 | 18.7 | 0.91 | 0.09 | 2.2 |
| 10 | 4.2 | 6.0 | 2.3 | 0.50 | 0.50 | 17.6 |

TABLE II-continued

| Stream Ref. | Stream Compositions | | | | | |
|---|---|---|---|---|---|---|
| | $Na_2O$ | $CO_2$ | $NH_3$ | x | z | h |
| 13 | 4.7 | 3.3 | 0 | 0 | 0.50 | 33.1 |

*Stream 5 composition analyses are average values for the slurry.

We claim:

1. A cyclic method for recovering alkali values from mechanically mined trona ore, which comprises
   (i) contacting trona ore with an aqueous ammonia solvent containing about 0.5 to 4% by weight $NH_3$ to effect dissolution of sodium sesquicarbonate in the ore;
   (ii) separating the resultant solution from the undissolved portion of the ore;
   (iii) crystallizing alkali values from the separated solution;
   (iv) recovering the crystallized solids from the solution, leaving a mother liquor;
   (v) regenerating aqueous ammonia solvent from the mother liquor; and
   (vi) recycling the regenerated aqueous ammonia solvent to step (i) and repeating the cycle of recovery.

2. The method of claim 1 wherein the aqueous ammonia solvent contains sufficient ammonia to effect congruent dissolution of the sodium sesquicarbonate in the ore.

3. The method of claim 1 wherein the relative amounts of trona ore and aqueous ammonia solvent are adjusted to provide for substantially complete dissolution of the soluble portion of the ore being contacted with solvent and the production of a separated solution that is essentially saturated with respect to the ore.

4. A cyclic method for recovering alkali values from underground trona ore deposits, which comprises
   (i) introducing into the region of the trona ore deposit an aqueous ammonia mining solvent containing about 0.5 to 4% by weight $NH_3$ resulting from the process set forth below and having dissolved therein sufficient ammonia to effect congruent dissolution of sodium sesquicarbonate in the ore;
   (ii) withdrawing from the region at least a portion of the resulting solution;
   (iii) crystallizing alkali values from the withdrawn mining solution in an amount essentially equivalent to that solubilized by the aqueous ammonia solvent and contained in the withdrawn solution;
   (iv) recovering the crystallized solids from the mining solution, leaving a mother liquor;
   (v) regenerating aqueous ammonia solvent from the mother liquor, the regeneration including the addition of sufficient water and ammonia to the mother liquor to compensate substantially for that in the volume of solvent left in the region of the trona deposit; and
   (vi) recycling the regenerated aqueous ammonia solvent to step (i) and repeating the cycle of recovery.

5. The method of claim 4 wherein the alkali values are recovered as a crystallized sodium salt selected from the group consisting of sodium sesquicarbonate, anhydrous sodium carbonate and hydrates of sodium carbonate.

6. The method of claim 1 or 4 wherein the aqueous ammonia solvent contains from about 1% to 4% ammonia, expressed weight percent $NH_3$.

7. The method of claim 1 or 4 wherein the temperature of the aqueous ammonia solvent in step (i) is from 20° C. to 80° C.

8. The method of claim 1 or 4 wherein the aqueous ammonia solvent is maintained in contact with the ore until the resulting solution is at least 50% saturated with respect to the soluble portion of the ore.

9. The method of claim 1 or 4 wherein the alkali values are crystallized from the solution by the addition to the solution of ammonia at a temperature of from 20° C. to 50° C., and mother liquor, which remains after recovery of the crystallized solids therefrom, is processed to recover the crystallization ammonia.

10. The method of claim 1 or 4 wherein the alkali values are crystallized from the solution as sodium carbonate monohydrate.

11. The method of claim 10 which further comprises drying the recovered sodium carbonate monohydrate to form soda ash.

12. The method of claim 1 or 4 wherein the alkali values are crystallized from the solution as sodium sesquicarbonate.

13. The method of claim 12 wherein carbon dioxide is introduced into the solution from which sodium sesquicarbonate is crystallized so as to induce precipitation of additional amounts of sesquicarbonate from the solution.

14. The method of claim 12 which further comprises calcining the recovered sodium sesquicarbonate crystals to form soda ash.

15. The method of claim 1 or 4 wherein the ammonia solvent contains from about 1 to 4% by weight $NH_3$ and the alkali values are crystallized by the evaporative removal of the ammonia contained in the solution, the ammonia being reintroduced into the mother liquor after recovery of the crystallized alkali values therefrom to regenerate aqueous ammonia solvent.

16. The method of claim 15 wherein the alkali values are crystallized as sodium sesquicarbonate.

17. The method of claim 1 or 4 wherein regeneration of the aqueous ammonia solvent includes removal of carbon dioxide from the mother liquor.

18. The method of claim 17 wherein removal of the carbon dioxide is effected by decomposition of ammonium salt, present in the liquor as the neutralization byproduct of the solubilization of sodium sesquicarbonate with aqueous ammonia solvent, thereby forming gaseous ammonia and carbon dioxide, separating the carbon dioxide from the ammonia, and restoring the ammonia to the $CO_2$-free liquor.

19. The method of claim 18 wherein the mother liquor is heated to a temperature above 50° C. to decompose the ammonium salt.

* * * * *

UNITED STATES PATENT AND TRADEMARK OFFICE

CERTIFICATE OF CORRECTION

PATENT NO. : 4,283,372

DATED : August 11, 1981

INVENTOR(S) : W. R. Frint, W. C. Copenhafer, M. L. Pinsky

It is certified that error appears in the above—identified patent and that said Letters Patent is hereby corrected as shown below:

Claim 5 should read:

5. The method of claim 1 or 4 wherein the alkali values are recovered as a crystallized sodium salt selected from the group consisting of sodium sesquicarbonate, anhydrous sodium carbonate and hydrates of sodium carbonate.

Column 7, lines 53-60, the denominators of the formulas shown as "y-x" should be --(y-x)--.

Column 9, line 44, "recrystallization" should read --crystallization--. Column 21, line 55, "5.8%" should read --5.8% $NH_3$--. Column 22, line 1, "to" should read --at--. Column 23, line 16, "$NH_2$" should read --$NH_3$--. Column 24, line 19, "is" should read --in--.

Signed and Sealed this

Nineteenth Day of January 1982

[SEAL]

Attest:

GERALD J. MOSSINGHOFF

Attesting Officer

Commissioner of Patents and Trademarks